US005218161A

United States Patent [19]

Martin

[11] Patent Number: 5,218,161

[45] Date of Patent: Jun. 8, 1993

[54] PROJECTILE WALL BARRAGE SYSTEM

[75] Inventor: Scott G. Martin, Alta Loma, Calif.

[73] Assignee: Hughes Aircraft Company, Los Angeles, Calif.

[21] Appl. No.: 695,846

[22] Filed: May 6, 1991

[51] Int. Cl.[5] ..... F41B 6/00

[52] U.S. Cl. ..... 89/8; 89/41.03; 89/41.13

[58] Field of Search ..... 89/8, 41.03, 41.13

[56] References Cited

U.S. PATENT DOCUMENTS

| | | | |
|---|---|---|---|
| 2,925,965 | 2/1960 | Pierce | 244/14 |
| 3,974,740 | 8/1976 | Billottet et al. | 89/41.07 |
| 4,449,041 | 5/1984 | Girard | 235/412 |
| 4,640,180 | 2/1987 | Rose | 89/8 |
| 4,729,319 | 3/1988 | Orlando | 102/351 |
| 4,791,850 | 12/1988 | Minovitch | 89/8 |
| 4,836,083 | 6/1989 | Triezenberg | 89/8 |
| 4,895,062 | 1/1990 | Chryssomallis et al. | 89/8 |
| 4,974,487 | 12/1990 | Goldstein et al. | 89/8 |
| 5,081,901 | 1/1992 | Kemeny et al. | 89/8 |
| 5,121,672 | 6/1992 | Haglund | 89/41.03 |

FOREIGN PATENT DOCUMENTS

| | | | |
|---|---|---|---|
| 406199 | 1/1991 | European Pat. Off. | 89/41.03 |
| 230096 | 9/1990 | Japan | 89/41.03 |
| 1164107 | 9/1969 | United Kingdom | 89/126 |

OTHER PUBLICATIONS

The Electro-Magnetic Gun—Closer to Weapon-System Status, Military Technology (May 1988) pp. 80, 81, 83, 85 and 86.

Electrothermal Guns, National Defense (Sep. 1990), pp. 20-23.

*Primary Examiner*—Stephen C. Bentley

*Attorney, Agent, or Firm*—C. D. Brown; R. M. Heald; W. K. Denson Low

[57] ABSTRACT

An apparatus and method for discharging a group of projectiles for simultaneous impact at a target wherein the projectiles in the projectile group are sequentially fired at incrementally increasing velocities. More particularly, electrothermal gun technology may be employed and the energy imparted to each successively fired projectile may be increased so as to achieve the desired simultaneous target impact at a designated range.

13 Claims, 2 Drawing Sheets

PROJECTILE WALL BARRAGE SYSTEM

FIELD OF THE INVENTION

The present invention relates to weapons systems, and more particularly, to high fire rate single and multi-barrel gun-type weapons adapted to fire a plurality of projectiles in rapid sequence.

BACKGROUND OF THE INVENTION

High fire rate guns, such as those firing over 200 rounds per minute per barrel, may be used to propel a stream of projectiles at a designated target. Typically, the muzzle velocity and aerodynamic properties of the stream of projectiles are roughly consistent such that the projectiles arrive at any given range at the same linear spacing and in the order in which they were fired. Target movement, gun aiming and ammunition natural dispersion reduce chances that two projectiles will strike a target in the exact same spot. Target damage occurs as the projectiles individually impact the target, and projectiles that fail to impact the target cause it no damage.

It is known that target damage is substantially greater if it is hit simultaneously by several projectiles than if it is hit seriatim by the same number of projectiles. The problem has been to create a barrage or group of projectiles which arrive at the target intentionally and controllably simultaneously.

Previous weapons systems have attempted increased target damage by mimicking the simultaneous arrival of munitions by firing flechette rounds or a pattern of rounds. The flechette round achieves simultaneous arrival by separating smaller, lighter submunitions from the carrier projectile in flight. Lower fire rate, larger caliber weapons have attempted to mimic simultaneous arrival by re-positioning the barrel between rounds in a predetermined pattern. In this instance, the rounds still arrive in the order fired, and depend on fuse action to achieve target kill.

SUMMARY OF THE INVENTION

It is therefore an object of the present invention to increase the effective impact damage imparted to a target by a projectile stream.

It is a further object of this invention to improve the accuracy of a high fire rate gun-type weapon by minimizing the effects of gun aiming, target movement and ammunition natural dispersion.

It is a further object of the invention to affect a larger target area in a manner equivalent to the bursting of a larger caliber explosive round.

In accordance with the foregoing objectives there is provided an apparatus and method for discharging a group of projectiles for simultaneous impact at a target wherein the projectiles in the projectile group are sequentially fired at incrementally increasing velocities. More particularly, in one aspect of the invention, high fire rate electrothermal gun technology may be employed and the energy imparted to each successively fired projectile may be increased so as to achieve the desired simultaneous target impact at a designated range from the weapon.

BRIEF DESCRIPTION OF THE DRAWING

The objects, advantages and features of this invention will be more readily appreciated when read in conjunction with the accompanying drawing, in which.

DESCRIPTION OF THE PREFERRED EMBODIMENTS

Figure 1:
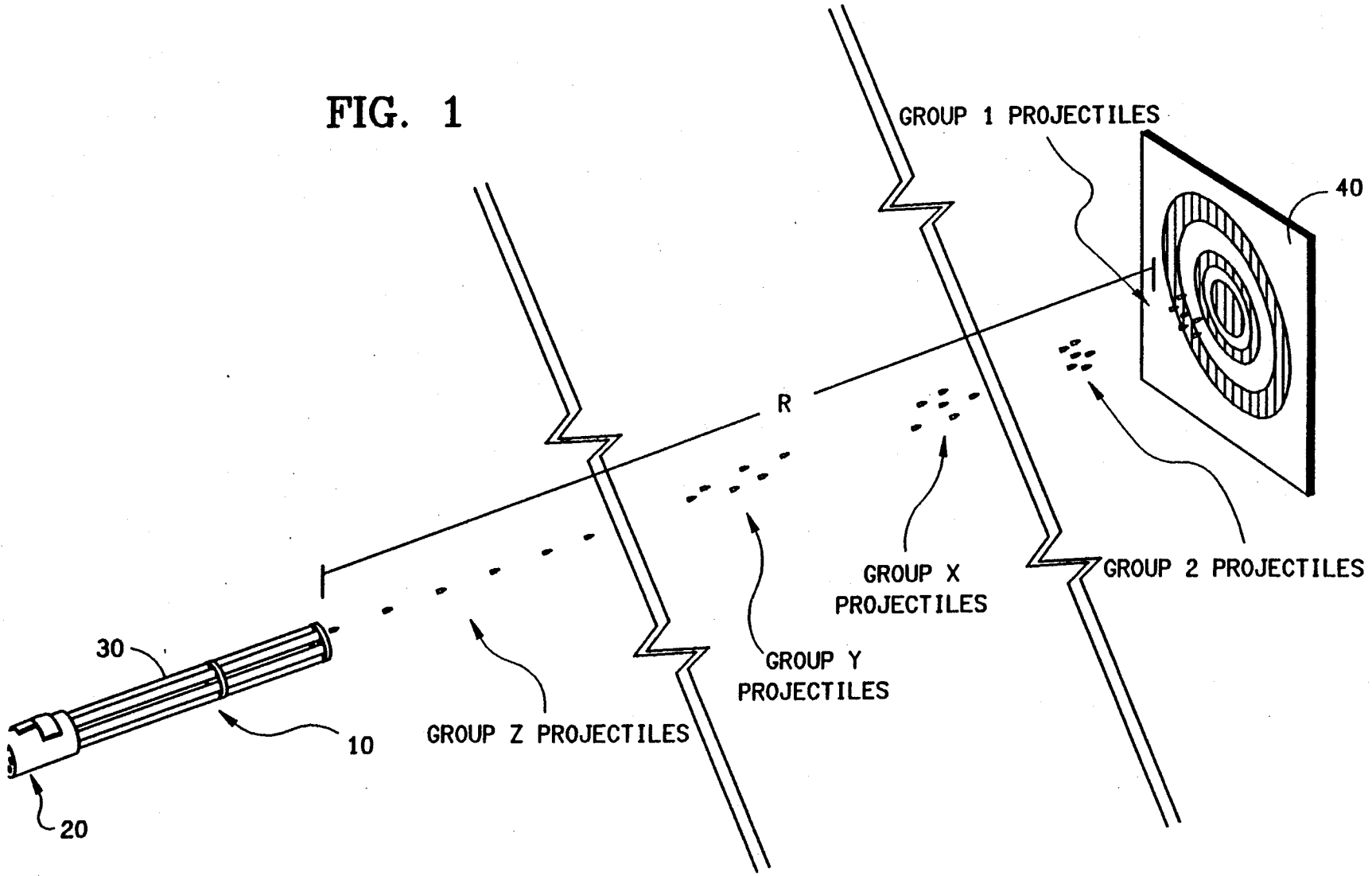
FIG. 1 is a perspective diagrammatic representation of a projectile discharge apparatus constructed in accordance with the present invention, showing the discharge of successive projectile groups.

Referring now to FIG. 1, a high fire rate multi-barrel Gatling gun-type weapon system 10 includes an electrothermal (ET) propulsion firing system 20 to sequentially discharge groups of projectiles through barrel system 30, toward target 40. A non-Gatling gun-type, single barrel system could also be employed. Propulsion system 20 is thus operatively connected to barrel system 30 and includes a projectile control system to control the energy imparted to and velocity at which the projectiles are discharged (muzzle velocity) through barrel system 30. The projectile control system thus may control successively discharged projectiles in a group of projectiles to simultaneously arrive at a predetermined target range.

The muzzle velocity controlling is done, for example, by adjusting the electrical energy input provided to an electrothermal gun system capable of changing muzzle velocity to enable a group of tandem launched projectiles to arrive simultaneously at a target. Other types of controllable muzzle or terminal velocity guns or projectile launchers may be used. One example is a liquid propellant gun but its flexibility and capabilities are much more limited than is the ET gun technology. Because the system is intended to be employed with a high fire rate gun (at least 200 rounds per minute per barrel) having continuously controllable muzzle velocity, electrothermal gun systems are preferred.

Examples of controllable muzzle velocity projectile launchers are described in U.S. Pat. Nos. 4,640,180; 4,729,319 and 4,836,083. Electrothermal gun systems are also discussed in two published articles, The Electro-Magnetic Gun—Closer to Weapon-System Status, Military Technology (May 1988), pp. 80, 81, 83, 85 and 86, and Electrothermal Guns, National Defense (September 1990), pp. 20–23.

In general, electrothermal gun technology involves using electrical energy acting on a working fluid to create a plasma behind a projectile. The plasma has the advantage, over conventional powder propellants, of having a lower molecular weight and hence a higher speed of sound capability, similar to the effects produced in light gas guns. Proper choice of the working fluid allows additional energy to be imparted to the projectile by adding a chemical energy input to the electrical energy input. This combination can yield extremely high efficiencies. Muzzle energy can be amplified by many times the electrical energy input required to create the plasma. Muzzle velocity of such a gun is controlled by changing the electrical energy input of the gun.

Figure 2:
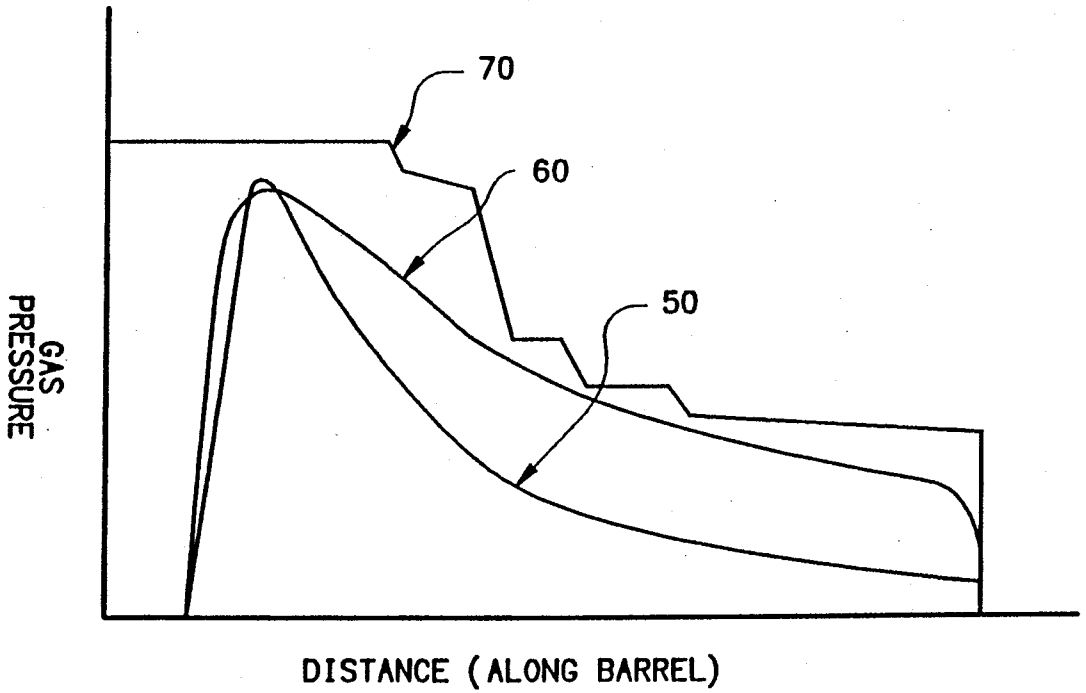
FIG. 2 is a graphical representation of pressure imparted on a projectile versus distance along a gun barrel.

Because the plasma is created by an electrical pulse, the electrical pulse can be tailored to maintain a high pressure behind the projectile as it travels down the barrel. At any point during this projectile travel down the barrel, the pressure can be maintained to nearly the yield strength of the barrel. While conventional propellant guns build up a high initial pressure that decays as the projectile moves down the barrel, the ET gun can attain a higher initial pressure and then maintain a high pressure to match barrel strength as the projectile moves down the barrel. FIG. 2 provides a graphical example of relative time/pressure curves available from conventional propellant (50) and ET guns (60). Shown for comparison is representative yield strength curve 70 for the gun barrel. Comparison of the areas under the pressure/time curves indicates that more energy is available to accelerate a projectile from an ET gun than from a conventional propellant gun.

It has been determined that an ET gun is capable of doubling the muzzle energy over that available from conventional propellant technology firing projectiles out of the same barrel. Using the relationship $K.E. = \frac{1}{2}MV^2$, where K.E. is kinetic energy, it may be concluded that either the launch mass may be doubled, the velocity increased by about 40%, or some launch mass/velocity increase combination arrived at.

It has been further determined that by shaping the ET gun electrical pulse to selectively tailor individual projectile muzzle velocities during weapon firing, groups of projectiles may be fired to arrive at a predetermined target range simultaneously with other projectiles in the projectile group.

Simultaneous arrival of the projectiles at a desired range utilizing incremental projectile energy increase requires consideration of several factors including the time delay between successive projectile firings, the estimated time until target impact, and the available incremental energy for projectiles 1 through m where m is the number of projectiles in the projectile group. Table 1 below illustrates the creation of groups of seven projectiles each from a weapon firing projectiles continuously.

TABLE 1

| PROJ. NO. | MUZZLE VEL. | TIME TO TGT. |
|---|---|---|
| 1 | V | T |
| 2 | V + Δv | T − Δt |
| 3 | V + 2Δv | T − 2Δt |
| 4 | V + 3Δv | T − 3Δt |
| 5 | V + 4Δv | T − 4Δt |
| 6 | V + 5Δv | T − 5Δt |
| 7 | V + 6Δv | T − 6Δt |
| 8 | V | T |
| 9 | V + Δv | T − Δt |
| 10 | V + 2Δv | T − 2Δt |
| 11 | V + 3Δv | T − 3Δt |
| 12 | V + 4Δv | T − 4Δt |
| 13 | V + 5Δv | T − 5Δt |
| 14 | V + 6Δv | T − 6Δt |
| * | * | * |
| * | * | * |
| * | * | * |
| n | V | T |
| n + 1 | V + Δv | T − Δt |
| n + 2 | V + 2Δv | T − 2Δt |
| n + 3 | V + 3Δv | T − 3Δt |
| n + 4 | V + 4Δv | T − 4Δt |
| n + 5 | V + 5Δv | T − 5Δt |
| n + 6 | V + 6Δv | T − 6Δt |

In Table 1, V = the velocity of the first projectile in a projectile group, T = the calculated time until target impact of the first projectile in a projectile group, Δt = the time delay between projectile firings, and Δv = the incremental velocity that must be imparted to successive projectiles to obtain simultaneous target impact.

Significantly, because each projectile in the projectile group is caused to simultaneously arrive at the target range, no gun aiming adjustment is required between successive rounds in the same group. Assuming the first projectile in a group of projectiles 1, 2, 3, ., ., m (where m designates a projectile in a group) is directed to impact the target at the calculated distance R, the required velocity ($V + m\Delta v$) for any projectile in the group would be given by the equation $R/(T - m\Delta t)$. From this, Δv can be readily determined.

In Table 1, it is preferred that velocity V at least equal the existing muzzle velocity of powder technology ammunition, such that no projectile capability is lost. Assuming ET technology yields an approximate 40% maximum velocity increase over powder technology, then $V + 6\Delta v$ cannot be greater than $V + 0.4$ V. ET gun technology, however, allows incrementing the velocity of subsequent rounds by the delta-velocities necessary to achieve simultaneous arrival of the projectiles at the desired range.

Referring now to FIG. 1, the relative formations of projectile groups 1 through Z, each comprised of six projectiles, illustrate the effect of incrementally increasing the velocity of successively fired projectiles in each group. The projectiles of Group 1 arrive simultaneously at the target at range R. Group 2 projectiles are, for example, 6Δt seconds behind Group 1 projectiles and have nearly formed into a side-by-side grouping. Groups X and Y projectiles are about halfway to the target and are somewhat more time dispersed, with projectiles #2–6 actively catching up to projectile #1 in each group. Group Z shows the projectiles as they serially exit the gun barrel.

As shown, the natural dispersion of the projectiles due to various mechanisms will create a "wall" of projectiles at target range R. This simultaneous arrival of projectiles at the target has important implications. First, simultaneous impacts by multiple projectiles will have an increased negative effect on the target as the force of the overall impact will be multiplied by the number of impacts as well as the reactions within the target material created by the interaction of shock waves resulting from the impacts. Second, simultaneous arrival combined with dispersion of the rounds creates a potential, more lethal, damage area equivalent to the bursting of a larger caliber high explosive round.

Simultaneous arrival of projectiles fired from a high fire rate gun has not been possible with existing powder technology guns. By combining the high fire rate, electrothermal gun technology, and tailoring individual round velocities, this invention uniquely provides a high fire rate weapon with the capability of placing several projectiles at the same range simultaneously. The effect of simultaneous impacts by complete projectiles will certainly be more devastating to a target than individual serial impacts.

Accordingly, a projectile wall barrage system has been disclosed. While several aspects and embodiments have been shown and described, it should be understood that modifications and adaptations thereof will occur to persons skilled in the art. Therefore, the protection afforded the invention should only be limited in accordance with the spirit of the following claims and their equivalents.

What is claimed is:

1. A method for sequentially discharging a group of projectiles from a weapon having controllable muzzle velocity capability for approximate simultaneous impact at a target, the method comprising the steps of:

incrementally increasing the discharge energy imparted to each successive projectile in an amount sufficient to cause each said successive projectile to substantially overtake the first fired projectile of the projectile group at the target range; while maintaining constant the aim of the weapon, thereby resulting in a spread of projectiles at the target.

2. The method set forth in claim 1, wherein the discharge energy imparted to the last discharged projectile in the projectile group is approximately double the energy imparted to the first discharged projectile in the projectile group.

3. The method set forth in claim 1, wherein the last discharged projectile in the projectile group is discharged at a velocity that is approximately forty percent greater than the discharge velocity of the first discharged projectile in the projectile group.

4. The method set forth in claim 1, wherein the incremental increase in discharge energy is a function of the time delay between the discharge of successive projectiles.

5. The method set forth in claim 1, wherein the incremental increase in discharge energy is a function of the estimated time until the first discharged projectile arrives at the target and the time delay between the discharge of successive projectiles.

6. The method set forth in claim 4, wherein the incremental increase in discharge energy is also a function of muzzle velocity.

7. The method set forth in claim 5, wherein the incremental increase in discharge energy is also a function of muzzle velocity.

8. The method set forth in claim 1, wherein each projectile group contains about seven projectiles.

9. A high fire rate projectile discharging weapon system comprising:

a barrel system through which a plurality of projectiles may be successively discharged on substantially the same line of fire and having the natural dispersion characteristics of the barrel system to achieve lateral projectile separation;

a controllable propulsion system for propelling said plurality of projectiles through said barrel system; and a projectile control system for controlling the discharge energy applied to each projectile in said plurality of successively discharged projectiles to arrive at a target range approximately simultaneously to create a wall of projectiles at the target range.

10. The weapon system set forth in claim 9, wherein said propulsion system employs electrothermal gun technology.

11. The weapon system set forth in claim 9, wherein said projectile control system controls said plurality of projectiles by incrementally increasing the velocity at which said plurality of projectiles are discharged from said barrel system.

12. A high fire rate projectile discharging weapon comprising at least one barrel through which groups of projectiles may be successively discharged, each projectile within a group being discharged on substantially the same line of fire, said at least one barrel having natural dispersion characteristics which results in lateral projectile separation, an electrothermal projectile propulsion device operatively connected to said at least one barrel, said electrothermal projectile propulsion device including means for controlling the discharge energy imparted to said successively discharged projectiles to incrementally increase the discharge velocity of said projectiles to arrive approximately simultaneously at a predetermined target range in a wall-like dispersed pattern.

13. A method of creating a wall of projectiles at a predetermined range from a gun having a high fire rate and controllable muzzle velocity capability, the method comprising the steps of:

maintaining the aim of the gun constant and employing the natural dispersion characteristics of the gun to obtain a lateral spread of the projectiles fired from the gun; and incrementally increasing the discharged energy imparted to each successive projectile in a group of projectiles in an amount sufficient to cause each said successive projectile of said group to substantially overtake the first fired projectile of said projectile group at the target range.

* * * * *